US007358672B2

(12) United States Patent
Adachi et al.

(10) Patent No.: US 7,358,672 B2
(45) Date of Patent: Apr. 15, 2008

(54) PLASMA DISPLAY PANEL WITH LIGHT-SHIELD

(75) Inventors: Daisuke Adachi, Kameoka (JP); Hiroyuki Yonehara, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 232 days.

(21) Appl. No.: 10/546,004

(22) PCT Filed: Dec. 10, 2004

(86) PCT No.: PCT/JP2004/018850

§ 371 (c)(1),
(2), (4) Date: Aug. 18, 2005

(87) PCT Pub. No.: WO2005/059945

PCT Pub. Date: Jun. 30, 2005

(65) Prior Publication Data

US 2006/0145623 A1 Jul. 6, 2006

(30) Foreign Application Priority Data

Dec. 16, 2003 (JP) ..... 2003-417803

(51) Int. Cl.
*H01J 17/49* (2006.01)

(52) U.S. Cl. ..... 313/587; 313/586; 313/585

(58) Field of Classification Search ..... 313/582–587
See application file for complete search history.

(56) References Cited

U.S. PATENT DOCUMENTS 4,424,251 A * 1/1984 Sugishita et al. ..... 428/209
5,851,732 A * 12/1998 Kanda et al. ..... 430/321
6,664,029 B1 * 12/2003 Imai et al. ..... 430/313

FOREIGN PATENT DOCUMENTS

| | | |
|---|---|---|
| JP | 9-160243 | 6/1997 |
| JP | 2000-156166 | 6/2000 |
| JP | 2000-221671 | 8/2000 |
| JP | 2001-84833 | 3/2001 |
| JP | 2001-84912 A | 3/2001 |
| JP | 2002-75229 | 3/2002 |
| JP | 2002-83547 | 3/2002 |
| JP | 2003-131365 | 5/2003 |
| JP | 2003-151450 | 5/2003 |
| JP | 2003-187692 | 7/2003 |

OTHER PUBLICATIONS

International Search Report corresponding to application No. PCT/JP2004/018850 dated Mar. 29, 2005.

* cited by examiner

*Primary Examiner*—Nimeshkumar D. Patel
*Assistant Examiner*—Anne M Hines
(74) *Attorney, Agent, or Firm*—RatnerPrestia

(57) ABSTRACT

The plasma display panel disclosed has a front substrate and a rear substrate positioned to face each other. The front substrate includes display electrodes provided with scan electrodes and sustain electrodes, and a light-shield provided on a non-discharge area between display electrodes. A rear substrate includes phosphor layers to emit light by discharge. The display electrodes are composed of transparent electrodes, and bus electrodes. The bus electrodes are composed of a plurality of electrode layers and at least one of the electrodes is composed of a black layer having a product of the resistivity and layer thickness of not larger than 2 $\Omega cm^2$. A light-shield is composed of a black layer with the resistivity of not smaller than $1\times10^6$ $\Omega$cm.

10 Claims, 4 Drawing Sheets

PLASMA DISPLAY PANEL WITH LIGHT-SHIELD

This Application is a U.S. National Phase Application of PCT International Application PCT/JP2004/018850.

TECHNICAL FIELD

The present invention relates to a plasma display panel for plasma display device known as a large-screen, flat and lightweight display device.

BACKGROUND ART

The plasma display panel (hereafter referred to as PDP) generates ultra-violet ray in gas discharge, and excites phosphors to emit light by the ultra-violet ray to perform image displaying.

The plasma display panels are roughly divided into AC powered and DC powered in driving method, and into surface discharge and counter discharge in discharging method. Currently, however, surface discharge AC powered with three-electrode structure has become the mainstream technology due to capabilities for high definition display, large-sized screen, simple structure and easy manufacturing method.

The AC powered PDP consists of a front substrate and a rear substrate. The front substrate is a substrate made of glass or the like on which: display electrodes including scan electrodes and sustain electrodes; light-shields between adjacent display electrodes; a dielectric layer covering the electrodes; and a protective layer to cover the layers further, are formed. The rear substrate is a substrate made of glass or the like on which: a plurality of address electrodes crossing the display electrodes on the front substrate; a dielectric layer covering the electrodes; and ribs on the dielectric layer are formed. The front substrate and rear substrate are positioned facing each other so as to form discharge cells at crossings of discharge electrodes and data electrodes, and the discharge cells are provided with phosphor layers internally.

The display electrode is provided with a transparent electrode and a bus electrode. The bus electrode has a black electrode to block incoming light reflection and a low resistance metal-rich electrode.

More recently, the PDP attracts increasing attention among flat panel display technologies and is used widely as a display device for a place crowded with many people or to enjoy images at a large screen home-theater. This is because the PDP can respond to display faster and can be produced in large sizes easier than LCD, with wide viewing angles and a high picture quality due to self-lighting.

As to the configuration of black electrodes to compose the display electrode and the light-shield provided between the display electrodes, an example is disclosed in Japanese Patent Unexamined Publication No. 2002-83547: these electrodes are formed of a plurality of layers on the substrate and one of a plurality of the layers is a black layer, having a higher sheet resistance than the other layers, which forms the light-shields as well as the black electrodes integrally.

However, when the black layer is commonly used to the light-shield, a smaller resistance of the black layer would increase capacitance in the light-shield, causing an increase in power consumption. Contrarily, a larger resistance of the black layer would increase the resistance of transparent electrode composing the display electrode, causing a critical problem of poor image quality.

DISCLOSURE OF THE INVENTION

The PDP disclosed in the present invention has a pair of substrates that include at least one transparent front substrate and are positioned to face each other so that discharge spaces are formed between the substrates.

The front substrate has display electrodes provided with scan electrodes and sustain electrodes, and light-shields formed on non-discharge areas between the display electrodes.

The rear substrate has phosphor layers to emit light by discharge. The display electrode has a transparent electrode and a bus electrode. The bus electrode includes a plurality of electrode layers and at least one of the electrode layers is a black layer with a product of a resistivity and a layer thickness of not larger than 2 $\Omega cm^2$. The light-shield is a black layer with a resistivity of not smaller than $1\times10^6$ $\Omega cm$.

The configuration can prevent poor discharge due to voltage drops of the bus electrode in the black electrode and due to interferences of voltage wave shapes from the light-shield, enabling to reduce man-hour of the PDP manufacturing process and to provide a PDP with a high picture quality.

DETAILED DESCRIPTIONS OF THE INVENTION

Now, the PDP used in the exemplary embodiments of the present invention are described with reference to drawings.

The First Exemplary Embodiment

Figure 1:
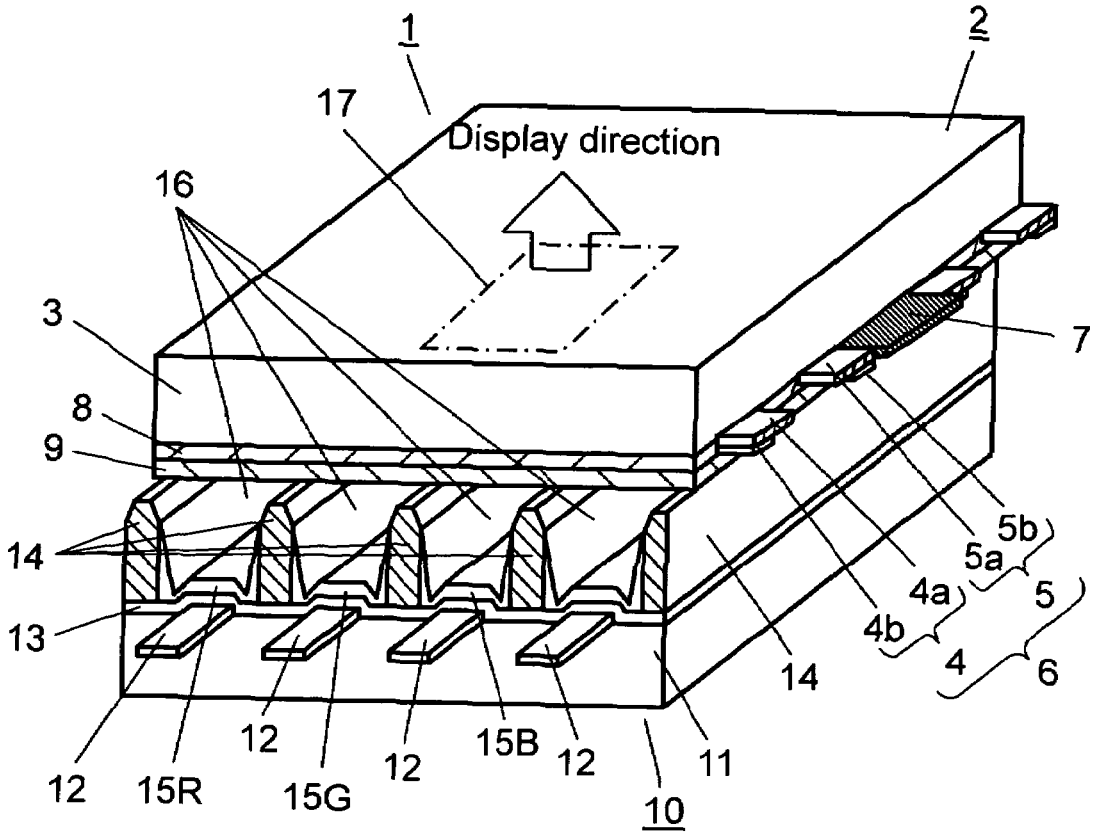
FIG. 1 illustrates a cross-sectional perspective view showing the main structure of the plasma display panel used in the first exemplary embodiment of the present invention.

FIG. 1 illustrates a cross-sectional perspective view showing the main structure of the plasma display panel used in the first exemplary embodiment of the present invention.

PDP 1 comprises front substrate 2 and rear substrate 5 positioned to face each other so that narrow discharge spaces 16 are formed as shown in FIG. 1. Front substrate 2 has display electrodes 6 including scan electrodes 4 and sustain electrodes 5 both arranged in stripe-shaped on glass substrate 3 so as to form surface discharge gaps. Scan electrodes 4 and sustain electrodes 5 are composed of transparent electrodes 4*a* and 5*a*, and bus electrodes 4*b* and 5*b* respectively.

Transparent electrodes 4*a* and 5*a* are for instance indium tin oxide (ITO) layer provided on glass substrate 3 by electron beam evaporation. A flat ITO layer is formed on glass substrate 3 before patterning resists on the layer to form transparent electrodes 4*a* and 5*a* by etching. $SnO_2$ can be adopted also as a material for transparent electrodes 4*a* and 5*a*.

Bus electrodes 4*b* and 5*b* are composed of a plurality of electrode layers, and at least one of the electrode layers is a black layer formed from a black material common to light shield 7. The black material is a mixture of: a black pigment (black oxides such as Cr—Co—Mn series, Cr—Fe—Co series or the like); a glass frit ($PbO—B_2O_3—SiO_2$ series, $Bi_2O_3—B_2O_3—SiO_3$ series or like); and a conductive material. A photosensitive black paste composed of the black material added with a photo-polymerization initiator, photo-hardening monomer, organic solvent or the like forms the black layer by the screen-printing method or the like. Moreover, the electrode layers or conductive layers are provided on the black layers. Specifically, the material used for the conductive layers is a photosensitive Ag-based paste including: a conductive material having Ag or the like; a glass frit ($PbO—B_2O_3—SiO_2$ series, $Bi_2O_3—B_2O_3—SiO_3$ series or the like); a photo-polymerization initiator; a photo-hardening monomer; and an organic solvent or the like. A layer of the photosensitive Ag-based paste formed on the black layers by screen-printing is patterned to form the conductive electrode layers by the photolithography.

Since formed from the black material common to bus electrode 4*b* and 5*b*, light shield 7 can be formed at the same time when the black layers are formed on transparent electrode 4*a* and 5*a*, thereby enabling to reduce man-hours of the PDP manufacturing process and to improve material usage rate. That is, a layer of the black material, a material for the black layer and light shield 7 as well, is formed on non-discharge area located between display electrodes 6 adjacent to each other. The black layers of bus electrodes 4*b* and 5*b*, and light shield 7 can be formed at the same time by patterning bus electrodes 4*b* and 5*b*, and light shield 7 respectively. Here, the black layer can be colored not only in true black but also in any blackish color such as gray color.

Subsequently, display electrodes 6 and light shield 7 formed as above are covered by dielectric layer 8. Dielectric layer 8 is formed from a paste containing lead-based glass materials coated by for instance screen printing and is dried before sintering. Then, dielectric layer 8 is covered by protective layer 9 to complete front substrate 2. Protective layer 9 composed of for instance MgO is formed by vacuum evaporation or sputtering.

Next, rear substrate 10 has address electrodes 12 formed on glass 11 arranged in stripe-shaped. Specifically, a material for address electrodes 12, a photosensitive Ag-based paste or the like, is applied to form a layer on glass substrate 11 by screen printing or the like and then the layer patterned by lithography or the like before sintering.

Subsequently, address electrodes 12 formed as above are covered by dielectric layer 13. Dielectric layer 13 is formed from a paste containing lead-based glass materials coated by for instance screen-printing and dried before sintering. Instead of printing the paste, laminating a precursor to dielectric layer molded in film-like before sintering can form the dielectric layer.

Next, ribs 14 are formed arranged in stripe-shaped. Ribs 14 can be formed from a layer, composed of a photosensitive paste containing mainly aggregates such as Al2O3 and glass frits and applied by die-coating or screen-printing, patterned by photo-lithography before sintering. Additionally, ribs can be formed from the paste, containing lead-based glass materials, coated repeatedly in a certain intervals by for instance screen-printing and dried before sintering. Here, gap dimensions between ribs 14 shall be of the order of 130 to 240 μm in the case of for instance 32 to 50 inch HD-TV.

Phosphor layers 15R, 15G and 15B having phosphor powders red (R), green (G) and blue (B) respectively are formed in a groove between two ribs 14. Each color of phosphor layer 15R, 15G and 15B is formed by; coating and drying a paste-like phosphor suspension composed of a phosphor powder and organic binders; and subsequently sintering it to burn off the organic binders at the temperature of 400 to 590° C., allowing the phosphor particles to adhere.

Front substrate 2 and rear substrate 10 produced as described above are positioned facing each other so that display electrodes 6 of front substrate 2 generally cross address electrodes 12 of rear substrate 10, and sealants such as sealing glasses applied into peripheral portions are sintered for instance at 450° C. or so for 10 to 20 minutes to form an air-tight sealing layer (not shown). Then, the inside of discharge spaces 16, once pumped to a high vacuum (for instance $1.1\times10^{-4}$ Pa), are filled with a discharge gas for instance Ne—Xe 5% at the pressure of 66.5 kPa (500 torr) to complete PDP 1.

By the configuration shown in FIG. 1, the crossing points of display electrodes 6 and address electrodes 12 in discharge spaces 16 work as discharge cells 17 (a unit discharge cell).

Additionally, the materials for the black layer include black pigments, conductive substances and frit glass in this exemplary embodiment, wherein ruthenium oxide can be used as a conductive substance to control the resistivity of the black layer by the additive amount. Some metals can also be used as a conductive substance (for instance, silver powder) to control the resistivity of the black layer by the additive amount.

The structure and electric property of display electrode 6 and light-shield 7 are described more in detail.

Figure 2:
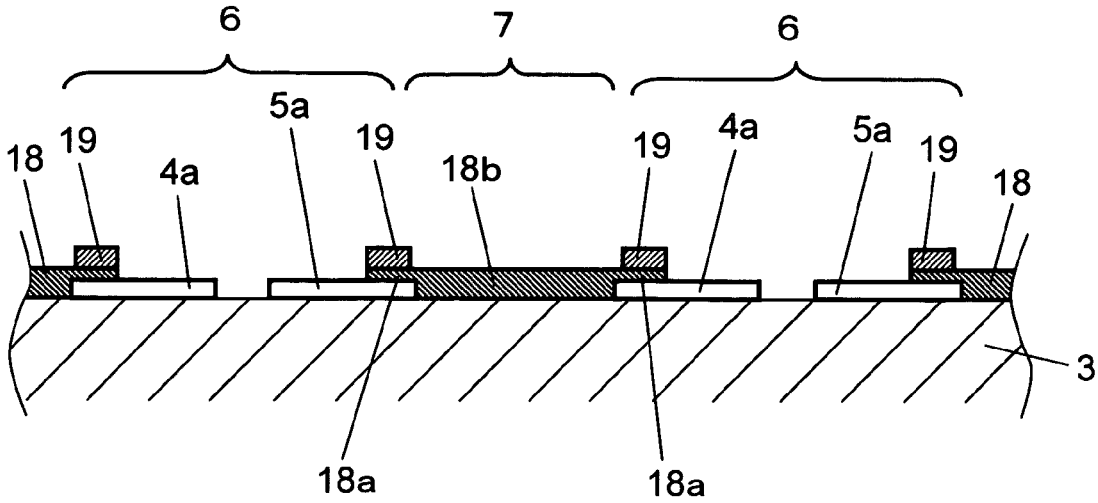
FIG. 2 illustrates a cross-sectional view showing the structure of the display electrodes and light-shield of the plasma display panel used in the first exemplary embodiment of the present invention.

FIG. 2 is a cross-sectional view showing the structure of the display electrode 6 and light shield 7 of the PDP in the first exemplary embodiment of the present invention. Scan electrodes 4 and sustain electrodes 5, both included in display electrodes 6, and light-shields 7 are provided on glass substrate 3 as shown in FIG. 2. A pair of scan electrode 4 and sustain electrode 5 make up display electrode 6, and non-discharge areas between respective display electrodes 6 adjacent to each other provide light-shields 7. Scan electrode 4 and sustain electrode 5 comprise: transparent electrode 4*a* and 5*a*, composed of $SnO_2$ or ITO, formed on glass substrate 3; and bus electrode 4*b* and 5*b* provided on transparent electrode 4*a* and 5*a* at the side of light-shield 7. Bus electrode 4*b* and 5*b* have a double-layered structure including black layer 18*a* and conductive layer 19 provided on black layer 18*a*.

Black layer 18*a* of bus electrode 4*b* and 5*b* is formed from the same material as light-shield 7, and black layer 18*a* and black layer 18*b* are formed connected. That is, display electrodes 6 adjacent to each other are connected via black layer 18*a* and black layer 18*b* of light-shield 7.

The product of the resistivity of black layer and layer thickness shall be not larger than 2 $\Omega cm^2$, and the resistivity of light-shield 7 composed of black layer 18*b* shall be not smaller than $1\times10^6$ Ωcm, in the exemplary embodiments of the present invention.

When adjacent display electrodes 6 are electrically connected each other via light-shield 7, the resistivity of smaller than $1\times10^6$ Ωcm for black layer 18*b* of light-shield 7 would cause for instance a part of current flowing through one of display electrodes 6 to flow into another adjacent display electrode 6 through light-shield 7. Eventually, voltage wave shapes of a display electrode will interfere with voltage wave shapes of another display electrode, causing to prevent required voltage wave shapes from sending to discharge cells The materials for the black layers, however, have a high resistivity of larger than $1\times10^6$ Ωcm so that black layers 18*b* have a resistance high enough enable to overcome such problems practically, in the exemplary embodiments of the present invention.

Additionally, a higher resistivity for black layer 18*a* formed from the same material as light-shield 7 would cause a phenomenon for discharge cells not to supply voltage required, due to voltage drops occurring in black layer 18*b* at the current flow from conductive layer 19 to transparent electrodes 4*a* and 5*a*. The phenomenon will begin to occur at larger than 0.5 $\Omega cm^2$ for the product of the resistivity and layer thickness, and becomes noticeable at larger than 2 $\Omega cm^2$. The specified value of not larger than 2 $\Omega cm^2$ for the product of a resistivity and layer thickness in the present invention, however, is high enough to overcome such problems practically.

Following is the reason why the product of resistivity and layer thickness is adopted to define the electrical resistance for black layer 18*a*, although the electrical resistance is generally defined by the resistivity or sheet resistance.

The relation between the resistance and resistivity of the black electrode is given by the formula $$R=\rho\times t/S,$$

where R is the resistance, ρ the resistivity, t the layer thickness and S the electrode area.

As described above, though the resistivity can be calculated by the resistance, layer thickness and electrode area, the resistivity value would be smaller than the resistivity of black layer 18*b* of light-shield 7 formed from apparently the same material from the following reasons.

That is, black layer 18*a* and conductive layer 19 both formed by thick layer manufacturing processes would produce uneven layer thickness with sometimes thinner portions, causing the portions with low resistance partially. Conductive substances of conductive layers 19 diffused into black layers 18*a* would reduce the resistivity of black layers 18*a*. Moreover, when patterning bus electrodes 4*b* and 5*b* by exposing for development, over-etching black layer 18*a* in developing process could lose black layer 18*a* provided under conductive layer 19, causing transparent electrode 4*a* to touch conductive layer 19 directly.

Although resistance R can be given from the measurement of voltage vs. current characteristics, and electrode area S from the measurement of exterior dimensions, to measure the layer thickness and resistivity of black layer 18*a* accurately is very difficult due to the above reasons. In the present invention, therefore, the electrical properties shall be specified by the product of the resistivity and layer thickness. The product is calculated easily with the resistance R and electrode area S given by the measurement method described later.

The Second Exemplary Embodiment

Figure 3:
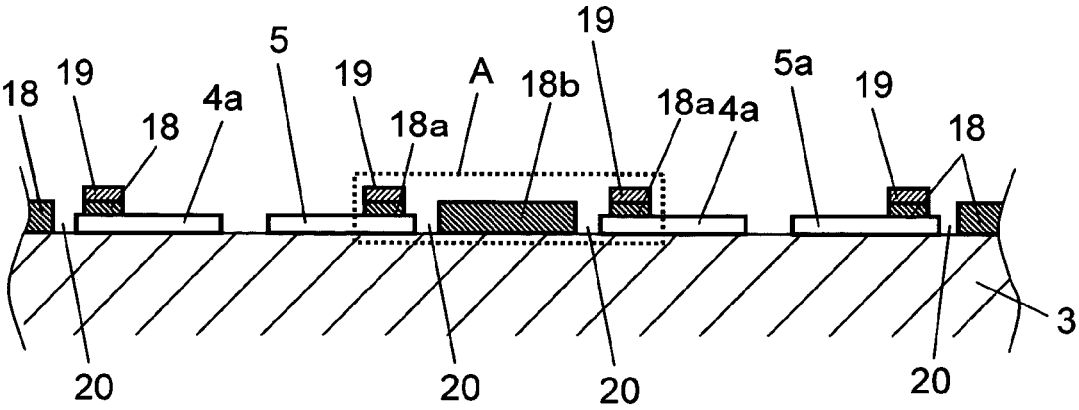
FIG. 3 illustrates a cross-sectional view showing the structure of the display electrodes and light-shield of the plasma display panel used in the second exemplary embodiment of the present invention.

FIG. 3 is a cross-sectional view showing the structure of display electrodes 6 and light-shield 7 of the PDP used in the second exemplary embodiment of the present invention. The second exemplary embodiment differs from the first exemplary embodiment in that the structure has slit 20 provided between display electrode 6 and light-shield 7 to insulate both sides electrically as shown in FIG. 3, and that the resistivity of light-shield 7 shall be not less than $1\times10^5$ Ωcm, leaving the other configurations the same as the first exemplary embodiment.

Slit 20 is formed by patterning after black layer 18*a* and light-shield 7 of bus electrodes 4*b* and 5*b* are formed integrally.

Since display electrode 6 and light-shield 7 are insulated electrically in the second exemplary embodiment, voltage wave-shape of one display electrode 6 will never interfere with another display electrode 6. The configuration enables to select a lower resistance material for black layer 18*a* composing bus electrode 4*b* and 5*b*, and for black layer 18*b* composing light-shield 7.

However, a low resistance of black layer 18*b* of light-shield 7 would increase the capacitance of a space between display electrodes 6 adjacent to each other via light-shield 7 (shown in space A in FIG. 3), causing a problem of increase in power consumption in PDP operation. The resistivity of black layer 18*b*, therefore, cannot be reduced needlessly but is necessary to have a certain level of insulation to restrain the increase in capacitance and power consumption. Specific resistivity of black layer 18*b* differs in the panel structure, the materials used for glass substrate, dielectric or the like, but the resistivity of not less than $1\times10^5$ Ωcm will be able to restrain the increase in power consumption.

Now, the measurement method of the product of the resistivity and layer thickness of black layers 18*a* and 18*b*, or the measurement method of the resistivity is described in detail.

Firstly, the measurement method of the product of the resistivity and layer thickness of black layers 18*a* of bus electrodes 4*b* and 5*b* is described with reference to FIG. 4. FIG. 4 is to show a flow to get a product of the resistivity and layer thickness for the black layer.

Figure 4A:
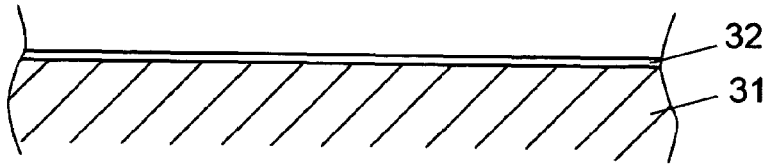
FIG. 4 illustrates a view showing a method to get a product of the resistivity of the black layer of the light-shield and the layer thickness.
Figure 4B:
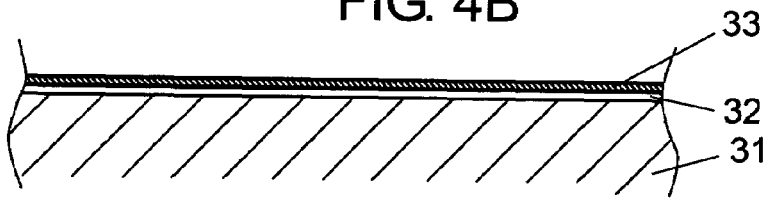
Figure 4C:
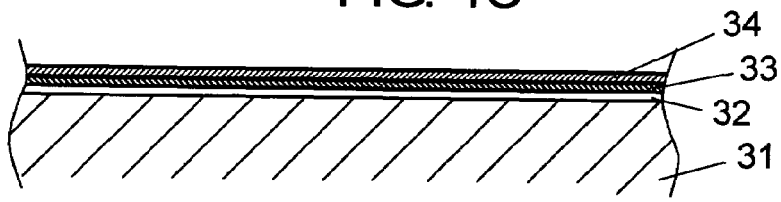
Figure 4D:
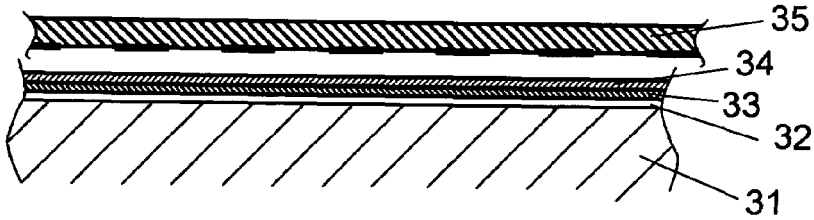

The manufacturing method of a measuring sample is described first. Flat layer 32 is formed on glass substrate 31 as a transparent electrode. No patterning is necessary in this process (FIG. 4A). Then, a photo-sensitive black paste is coated on transparent electrode 32 by a printing method or the like and then is dried to form dried black flat layer 33 (FIG. 4B). Next, a photosensitive conductive paste is coated on dried black flat layer 33 by a printing method or the like and then is dried to form dried conductive flat layer 34 (FIG. 4C). Dried black flat layer 33 and dried conductive flat layer 34 produced as above are exposed with exposure mask 35 attached so as to form 100 μm (W)×20 mm (L) with respective gaps of 100 μm (G) (FIG. 4D). The developing and sintering processes will form double-layered electrode patterns composed of stripe-shaped black layer 38 and conductive layer 39 on transparent electrode 32 on glass substrate 31 (FIG. 4E).

Figure 4E:
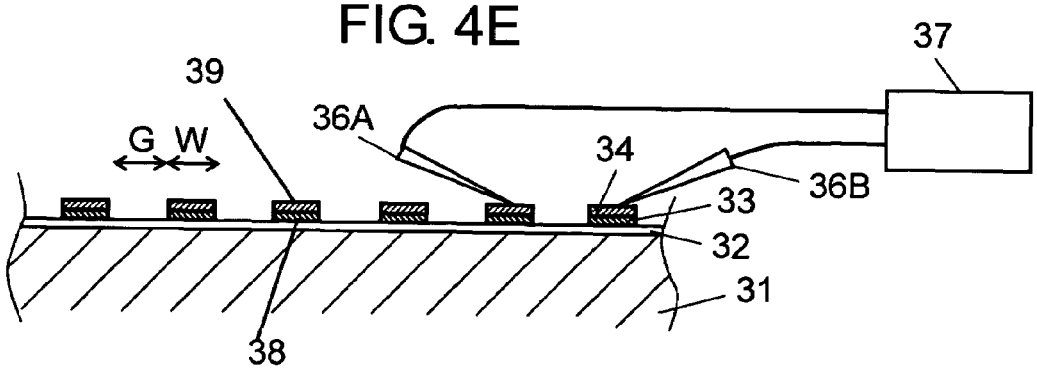

Resistance value (R) of the gap between electrode patterns adjacent to each other are measured by using probes 36A and 36B of resistance-measuring-equipment 37 as shown in FIG. 4E. The line width (W) and length (L) of the sample are measured by the length-measuring machine. Fracture cross sections of black layer 38 are observed and then the layer thickness (d) is measured by the scanning electron microscope or the like. The results are substituted into the formula $\rho\times t=R\times W\times L$, to calculate the product of resistivity ρ and layer thickness t. Since the layer thickness of black layer 38 is generally uneven, the average of layer thickness of black layer 38 shall be the layer thickness of black layer 38 here. Although the calculation results would include the resistance of transparent electrode 32 practically, it can be neglected since the resistance of transparent electrode 32 is much smaller than the resistance of black layer 38.

Next, the measurement method for the resistivity of the black layer of light-shield is described with reference to FIG. 5. FIG. 5 is a view showing a flow to get the resistivity for the black layer of the light-shield.

Figure 5A:
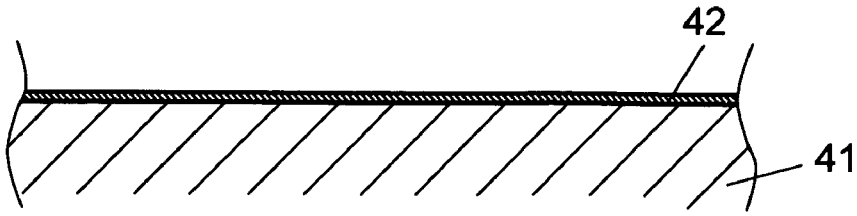
FIG. 5 illustrates a view showing a method to get the resistivity of the black layer of the light-shield.
Figure 5B:
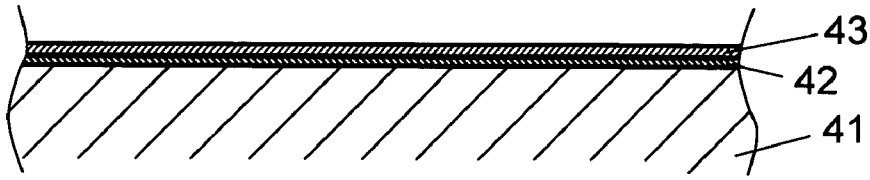
Figure 5C:
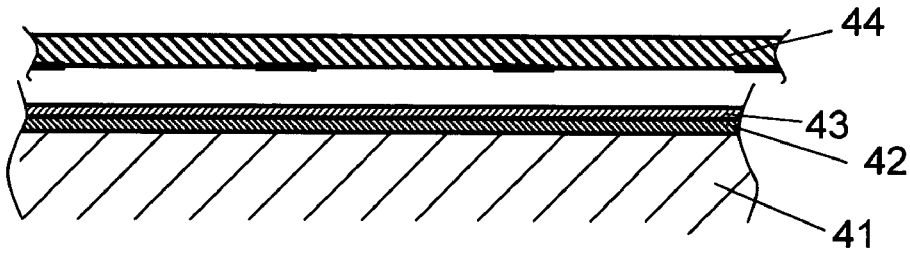

Firstly, a photo-sensitive black paste is coated on glass substrate 41 by the printing method or the like and then is dried to form dried black flat layer 42 (FIG. 5A). Then, the full surface of dried black flat layer 42 is exposed. Next, a photosensitive conductive paste is coated by the printing method or the like and then is dried to form dried conductive flat layer 43 (FIG. 5B). Dried black flat layer 42 and dried conductive flat layer 43 produced as above are exposed with exposure mask 44 attached so as to form 100 μm (W2)×20 mm (L2) with respective gaps of 5 m (G2) (FIG. 5C). The following development and sintering processes will form conductive electrodes 47 on black layer 42 on glass substrate 41 (FIG. 5D).

Figure 5D:
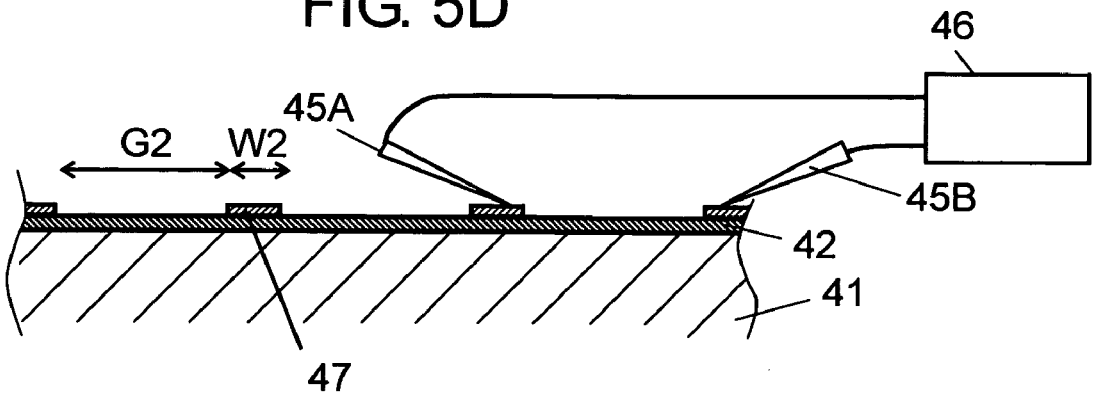

Resistance (R2) of the gap between conductive electrodes 47 adjacent to each other are measured by using probes 45A and 45B of resistance-measuring-equipment 46 as shown in FIG. 5D. The length (L2) and gap (G2) of the sample are measured by the length-measuring machine, and the layer thickness (d2) of the light-shield is by the sensing pin type roughness gauge. The results are substituted into the formula:

$$\rho 2 = R2 \times d2 \times L2 / G2,$$

to calculate the resistivity ρ2 of the black layer of light-shield.

Although the calculation results will include partial resistance components of black layer 42 under conductive layer 47 practically, it can be neglected if G2 is made up large enough than W2.

Table 1 shows the comparison of the power consumption and display characteristics varying the properties of black layer 18*a* and 18*b* at non-brightness for the PDP, provided with slit 20 between black layer 18*b* of light-shield 7 and display electrode 6 to insulate light-shield 7 from display electrode 6 electrically, described in the second exemplary embodiment.

In table 1, the resistivity of black layers 18*a* and 18*b* are controlled by varying the content of ruthenium-based oxide, used as a conductive material, for sample No. 2 to 5. Silver powder is added to ruthenium-based oxide for sample No.1 and no conductive material is used for No. 6. Sample No. 7 is a conventional example where the light-shield and black layer of bus electrode are manufactured by using different materials respectively.

The power consumption at non-brightness means a power consumed to display black in full-screen to compare with the conventional example No.7. The starting characteristic shows whether each PDP can start at the voltage on which conventional example No. 7 operates fully.

Sample no. 1 and no. 2 provided with light-shield having resistivity lower than $2\times10^4$ Ωcm show a larger power consumption at non-brightness than conventional example no. 7, and the power consumption at non-brightness increases with decreasing resistivity of light-shield as shown in table 1. Additionally, the power consumption at non-brightness saturates with the resistivity higher than $1\times10^5$ Ωcm for the light-shield.

The product of the resistivity of black electrode and layer thickness higher than 0.5 $\Omega cm^2$ causes a phenomenon of a little decrease in brightness in a portion of the screen due to a voltage drop to be supplied to the discharge spaces. The phenomenon becomes more noticeable in sample no. 5 and no. 6 where the product of the resistivity of black layer and layer thickness increases higher than 2 $\Omega cm^2$, so that non-brightness portions or decreases in brightness are observed in whole screen.

However, sample no. 3 and no. 4 of the present invention show nice results in both the power consumption at non-brightness and starting characteristic.

INDUSTRIAL APPLICABILITY

The present invention as described above can reduce man-hour of PDP manufacturing process and can provide PDP apparatus capable of displaying high quality images. The technology will be useful for large-sized screen display.

TABLE 1

| Product of resistivity and layer thickness of black layer for bus electrode [$\Omega cm^2$] | Resistivity of black layer for light-shield [Ωcm] | Conductive materials in black layer | Starting characteristic | Power consumption at nonbrightness | Reference |
|---|---|---|---|---|---|
| No. 1 $5\times10^{-2}$ | $1\times10^{2}$ | ruthenium oxide + silver | ○ | Large | Comparative example 1 |
| No. 2 $3\times10^{-1}$ | $2\times10^{4}$ | ruthenium oxide | ○ | Largish | Comparative example 2 |
| No. 3 $8\times10^{-1}$ | $1\times10^{5}$ | ruthenium oxide | ○ | ○ | Present invention 1 |
| No. 4 $2\times10^{0}$ | $1\times10^{8}$ | ruthenium oxide | ○ | ○ | Present invention 2 |
| No. 5 $6\times10^{0}$ | $5\times10^{2}$ | ruthenium oxide | ○ Δ a few | ○ | Comparative example 3 |
| No. 6 $1\times10^{2}$ | $5\times10^{11}$ | — | X | ○ | Comparative example 4 |
| No. 7 $2\times10^{-1}$ | $5\times10^{11}$ | — | ○ | ○ | Conventional example 1 |

The invention claimed is:

1. A plasma display panel having a pair of substrates with at least one transparent front side and positioned to face each other so that discharge spaces are formed between the substrates comprising:

a front substrate;

display electrodes provided on the front substrate, the display electrodes including a transparent electrode and a bus electrode disposed on a side of the transparent electrode opposite the front substrate;

a light-shield formed on a non-discharge area between the display electrodes; and a rear substrate having phosphor layers to emit light by discharge, wherein the bus electrode includes at least one black layer with a product of a resistivity and a layer thickness of not larger than 2 $\Omega cm^2$ and the light-shield is composed of a black layer with a resistivity of not smaller than $1\times10^5$ $\Omega cm$, and the light-shield extends from the front substrate along a side of the transparent layer to the black layer.

2. The plasma display panel of claim 1, wherein the black layer includes at least a black pigment and a conductive material.

3. The plasma display panel of claim 2, wherein the conductive material is an oxide including one of ruthenium and ruthenium oxide.

4. The plasma display panel of claim 2, wherein the conductive material is a metal conductive material.

5. The plasma display panel of claim 4, wherein the metal conductive material includes at least one of Ag, Cu, Pd, Pt and Au.

6. A plasma display panel having a pair of substrates with at least one transparent front side and positioned to face each other so that discharge spaces are formed between the substrates comprising:

a front substrate;

display electrodes provided on the front substrate, the display electrodes including a transparent electrode and a bus electrode;

a light-shield formed on a non-discharge area between the display electrodes; and a rear substrate having phosphor layers to emit light by discharge, wherein the bus electrode includes at least one black layer with a product of a resistivity and a layer thickness of not larger than 2 $\Omega cm^2$ and the light-shield is composed of a black layer with a resistivity of not smaller than $1\times10^6$ $\Omega cm$; and the black layer and the light-shield are composed of the same material and also the black layer and the light-shield are insulated electrically from each other.

7. The plasma display panel of claim 6, wherein the black layer includes at least a black pigment and a conductive material.

8. The plasma display panel of claim 7, wherein the conductive material is an oxide including one of ruthenium and ruthenium oxide.

9. The plasma display panel of claim 7, wherein the conductive material is a metal conductive material.

10. The plasma display panel of claim 9, wherein the metal conductive material includes at least one of Ag, Cu, Pd, Pt and Au.

* * * * *